US006443370B1

(12) United States Patent
Brulle et al.

(10) Patent No.: US 6,443,370 B1
(45) Date of Patent: Sep. 3, 2002

(54) SPRAY HEAD FOR A LIQUID-PRODUCT DISTRIBUTOR

(75) Inventors: François Brulle, Pacy-sur-Eure; Ludovic Petit, Vitot, both of (FR)

(73) Assignee: Valois S.A., Paris (FR)

( * ) Notice: Subject to any disclaimer, the term of this patent is extended or adjusted under 35 U.S.C. 154(b) by 0 days.

(21) Appl. No.: 09/600,131

(22) PCT Filed: Jan. 15, 1999

(86) PCT No.: PCT/FR99/00063

§ 371 (c)(1),
(2), (4) Date: Nov. 20, 2000

(87) PCT Pub. No.: WO99/36185

PCT Pub. Date: Jul. 22, 1999

(30) Foreign Application Priority Data

Jan. 16, 1998 (FR) ..... 98 00442

(51) Int. Cl.[7] ..... B05B 9/043

(52) U.S. Cl. ..... 239/333; 239/464; 239/483; 239/491; 239/493; 239/533.1; 239/533.13; 239/602; 222/321.6; 222/494

(58) Field of Search ..... 239/333, 327, 239/340, 373, 463, 464, 468, 469, 473, 491–494, 497, 533.1, 533.13, 570, 571, 602, 451, 452, 453, 456, 459, 483; 222/321.6, 525, 491, 492, 494; 604/48, 73

(56) References Cited

U.S. PATENT DOCUMENTS 1,342,486 A * 6/1920 Wolfard ..... 239/453
1,898,325 A * 2/1933 Venn ..... 239/453
3,057,560 A * 10/1962 Campbell ..... 239/453
3,913,803 A 10/1975 Laauwe
4,120,456 A 10/1978 Kimura et al.
4,182,496 A 1/1980 Burke
5,037,007 A * 8/1991 Deussen ..... 222/321.6
5,154,325 A * 10/1992 Ryder et al. ..... 222/494
5,195,665 A * 3/1993 Lina ..... 222/321.6
5,855,322 A * 1/1999 Py ..... 239/333

FOREIGN PATENT DOCUMENTS

EP 686 433 12/1995

* cited by examiner

*Primary Examiner*—Steven J. Ganey
(74) *Attorney, Agent, or Firm*—Sughrue Mion, PLLC

(57) ABSTRACT

The invention relates to a spray head (100) for a fluid dispenser for dispensing a fluid, the spray head being provided with an expulsion channel (1) opening out in a spray orifice (9), and with a moving closure member (10) mounted to move between a closed position, in which it closes said orifice (9), and a spray position, said closure member (10) being urged resiliently towards its closed position, and being displaced towards its spray position by the pressure of the fluid, the spray head being provided with a swirl chamber (20) of variable volume, the volume of said swirl chamber (20) being at its maximum when the closure member (10) is in the spray position, and being substantially zero when said closure member is in the closed position, said spray head being characterized in that said closure member (10) is provided with the spray orifice (9) and with swirl channels (30) which, when the closure member is in the spray position, connect said expulsion channel (1) to said swirl chamber (20), the volume and the geometrical configuration of said channels (30) remaining unchanged whatever the position of the closure member (10).

17 Claims, 4 Drawing Sheets

SPRAY HEAD FOR A LIQUID-PRODUCT DISTRIBUTOR

The present invention relates to a spray head for a dispenser for dispensing a fluid, and more particularly to a spray head provided with a closure member.

Closure members for closing the outlet orifice of a spray head are, in particular, used in the pharmaceuticals field for solving the problem that at least some of the fluid that is to be dispensed risks becoming contaminated. Such closure members are generally actuated, i.e. opened, by the pressure generated by the pump while it is being actuated.

A commonly-used type of closure member is made in the form of a one-way valve, and it comprises a piston that can be slid and moved by the pressure generated by the pump. In general, the piston is mounted inside the expulsion channel via which the fluid is expelled from the dispenser device. The expulsion channel must therefore be large enough to contain the piston and to enable said piston to move. Such closure members are described in particular in Documents FR-2 671 329, and U.S. Pat. No. 4,830,284.

A drawback with those devices it that they do not make it possible to minimize unused volume. An essential characteristic of most current spray devices is that unused volume-in the expulsion channel is minimized. Such minimization is particularly important when the pumps need to be primed, where priming consists in actuating them one or more times to expel the air from the pump chamber and to replace it with the liquid to be dispensed. In order to open the dispensing orifice, and therefore in order to displace the closure member that closes it, it is necessary to generate sufficient pressure by actuating the pump. In which case, the larger the volume, i.e. the larger the quantity of air, the higher the number of times the pump must be actuated in order to prime it. In some cases, priming even becomes impossible, and standard-type pumps are not suitable for that type of application.

One way of solving that problem is to organize the closure member in a manner such that the fluid expulsion channel is defined inside the moving closure member which is then mounted to move relative to a fixed element of the spray head. In which case, the closure member incorporates the outlet orifice, and the expulsion channel is defined between said closure member and said fixed element of the spray head, which fixed element can then be organized in a manner such that the unused volume in the expulsion channel is minimized. Such a device is described, in particular, in Document DE-435 138.

Unfortunately, that type of device suffers from another major drawback. An essential requirement for spray devices nowadays is that the generated spray must be of good quality and must be constant every time the device is actuated. To produce such spray characteristics, spray heads generally include spray portions that are connected to the spray orifices and that are of particularly critical geometrical configuration. Such a spray portion is commonly made up of very narrow channels disposed at different angles and connected to the spray orifice. In the above-described known devices, it is clear that the geometrical configuration of the spray portion is modified considerably by the presence of closure members. The same applies to deformable closure members which, instead of being displaced in the expulsion channels, have deformable closure portions that open under the pressure of the fluid.

Document U.S. Pat. No. 3,913,803 discloses a closure member which is mounted to slide around a fixed element of the spray head, and which is organized in a manner such that, when it is in the spray position, a swirl chamber is generated upstream from the spray orifice as well as swirl channels connected to said swirl chamber so as to generate a proper spray. That swirl geometrical configuration is achieved by means of ribs and corresponding grooves, respectively on the moving closure member, and in the fixed element of the spray head.

Although that document makes it possible to generate a spray on actuating the device, the quality of the spray remains insufficient. The spray geometrical configuration as a whole, i.e. the swirl channels and the swirl chamber, is influenced by the closure member being displaced from its closed position to its spray position. In particular, the closure member being displaced gives rise to a progressive increase in the size of the geometrical configuration of the spray, which adversely affects the quality of the spray, in particular the constancy thereof each successive time the device is actuated. In that case, the quality and the intensity of the spray are dependent on the actuating force exerted on the pump, and actuating the pump too weakly can generate a poor quality spray.

Documents U.S. Pat. Nos. 4,120,456, 4,182,496, and EP-0 686 433 disclose closure members mounted to slide in dispenser heads so as to open and close the dispensing orifice. Such a head incorporates the orifice and the swirl profile, and the closure member is displaced towards the inside of the head away form the orifice by the pressure of the fluid. That type of closure member suffers from several drawbacks. Firstly the co-operation between the closure member, the dispenser orifice, and the spray profile must be defined very accurately so as to avoid both leakage and also any risk of the closure member jamming. Therefore, no dimensional tolerance is allowed, which complicates manufacture and assembly of the device. Secondly, in order to enable the closure member to be displaced towards the inside of the head, said head must be quite large in size, and the problem arises of too large an unused volume in the rest position. In addition, the efficiency of the device is not good because, in order to open the closure member, the pressure of the fluid acts in the opposite direction to the direction in which the fluid is expelled.

Another problem that can arise with spray heads concerns the risk of the fluid being contaminated at the spray orifice and/or at the closure member. With certain types of closure members in which the closure member slides relative to the spray head, there is a narrow gap between the closure member and the head, and bacteria or germs can penetrate into the head via said gap.

An object of the present invention is to provide a spray head for a fluid dispenser, which spray head does not reproduce the above-mentioned drawbacks.

An object of the present invention is thus to provide a spray head including a closure member, in which spray head the quality of the spray that is generated is good and constant each time the device is actuated. In particular, an object of the present invention is to provide a spray head in which the quality of the generated spray is identical to the spray from a device that does not have a closure member for closing the spray orifice.

An object of the present invention is also to provide a spray head provided with a closure member and in which the unused volume of the expulsion channel is minimized.

Another object of the present invention is to provide such a spray head that is simple and low-cost to make and assemble.

An object of the present invention is also to provide such a spray head that prevents any contamination of the fluid at the closure member and/or at the spray orifice.

Another object of the invention is to provide such a spray head that achieves all of the above-mentioned objects.

The present invention thus provides a spray head for a fluid dispenser for dispensing a fluid, the spray head being provided with an expulsion channel opening out in a spray orifice, and with a moving closure member mounted to move between a closed position, in which it closes said orifice, and a spray position, said closure member being urged resiliently towards its closed position, and being displaced towards its spray position by the pressure of the fluid, the spray head further being provided with a swirl chamber of variable volume, the volume of said swirl chamber being at its maximum when the closure member is in the spray position, and being substantially zero when said closure member is in the closed position, and said closure member is provided with the spray orifice and with swirl channels which, when the closure member is in the spray position, connect said expulsion channel to said swirl chamber, the volume and the geometrical configuration of said channels remaining unchanged whatever the position of the closure member.

Preferably, one end of the moving closure member is provided with the spray orifice and its other end is provided with a piston mounted to slide in leaktight manner in the expulsion channel.

Advantageously, in the closed position, the spray orifice is closed by an insert disposed in fixed manner in the expulsion channel, said swirl chamber being formed between said insert and said spray orifice when the closure member moves towards its spray position.

Preferably, said swirl chamber is cylindrical, the side wall and the top end face being formed by the closure member, and the bottom end face being formed by the insert.

Advantageously, said swirl channels open out in said side wall of the swirl chamber so that, when the closure member is in the closed position, they are closed by said insert.

Advantageously, said moving closure member comprises a hollow tubular sleeve provided with an end wall incorporating the spray orifice at its center, and a short hollow tube fitted in fixed manner inside the tubular sleeve in abutment against said end wall, the top surface of said tube that is in abutment against the end wall of the closure member being provided with one or more spray channels connecting the outside peripheral surface of said tube to the inside peripheral surface of said tube.

Advantageously, said short hollow tube is provided with one or more passageways in its outside peripheral surface fitted into the tubular sleeve of the closure member, said passageways being connected to said channels and forming a portion of the expulsion channel.

Preferably, said closure member is disposed to slide around an insert disposed in fixed manner in the spray head, said expulsion channel being defined at least in part between said closure member and said insert.

In an advantageous embodiment, said spray head comprises a body, a gasket-forming resilient element being disposed between the moving closure member and the body of the spray head, said resilient member urging said closure member towards its closed position and being compressed when the closure member moves towards its spray position.

In another advantageous embodiment, said spray head comprises a body underlying an elastically-deformable element fixed to said body, the closure member co-operating with said element which urges said closure member towards its closed position, and which is deformed when the closure member moves towards its spray position.

Preferably, the resiliently-deformable element is fixed in leaktight manner to said body of the spray head, and to said closure member, so that the leaktightness is guaranteed when the closure member is in any of its positions.

Advantageously, said elastically-deformable element is a cap made of elastomer thermoplastic.

Advantageously, one or more portions of said spray head that are in contact with the fluid include a bacteriostatic material.

Other characteristics and advantages of the present invention appear from the following detailed description of embodiments of the present invention given by way of non-limiting example and with reference to the accompanying drawings, in which.

Figure 1:
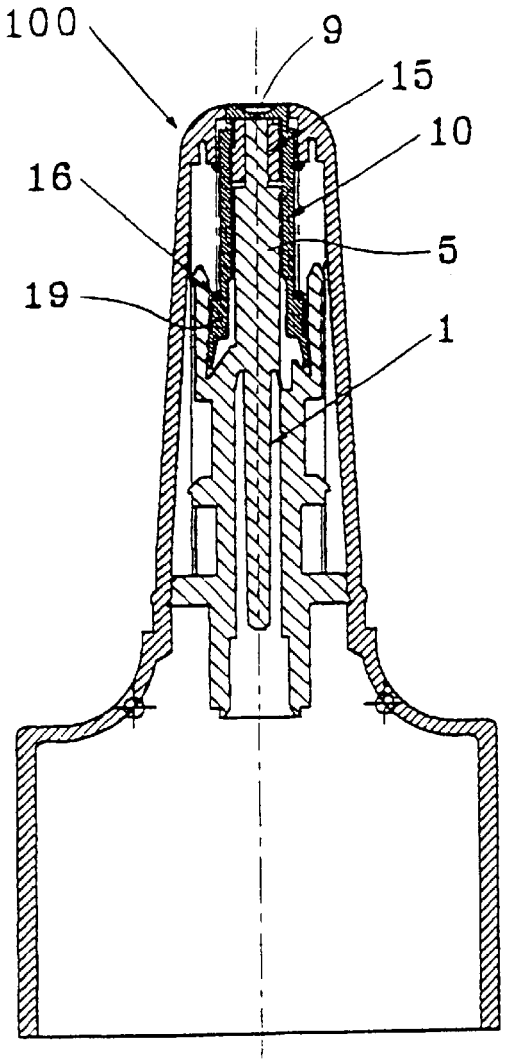
FIGS. 1 and 2 are diagrammatic section views of the spray head in an embodiment of the invention, when the closure member is respectively in the closed position and in the spray position.

With reference to the drawings, the spray head 100 shown has the general shape of a typical nasal applicator. Although it is mainly for this use that the quality and the constancy of the generated spray are important, the invention is not limited to being used in nasal-type applicators but rather, it can be adapted for all types of spray heads.

The present invention lies in the closure system for closing the spray orifice of the spray head. The overall shape and structure of the spray head are not described in any further detail herein, and the present description is limited to the invention itself.

The spray head 100 has a body 101 to which an insert is advantageously fixed in static manner. This insert an be referred to as an "inner" core and it defines in part the expulsion channel 1 of the spray head. A closure member 10 is disposed around the top portion of said insert 5. The closure member incorporates firstly the spray orifice 9 of the spray head and secondly a piston 19 which is mounted to slide in leaktight manner relative to said insert S. Thus, the expulsion channel 1 is defined at the top portion of the insert 5 between said insert 5 and said moving closure member 10.

Figure 2:
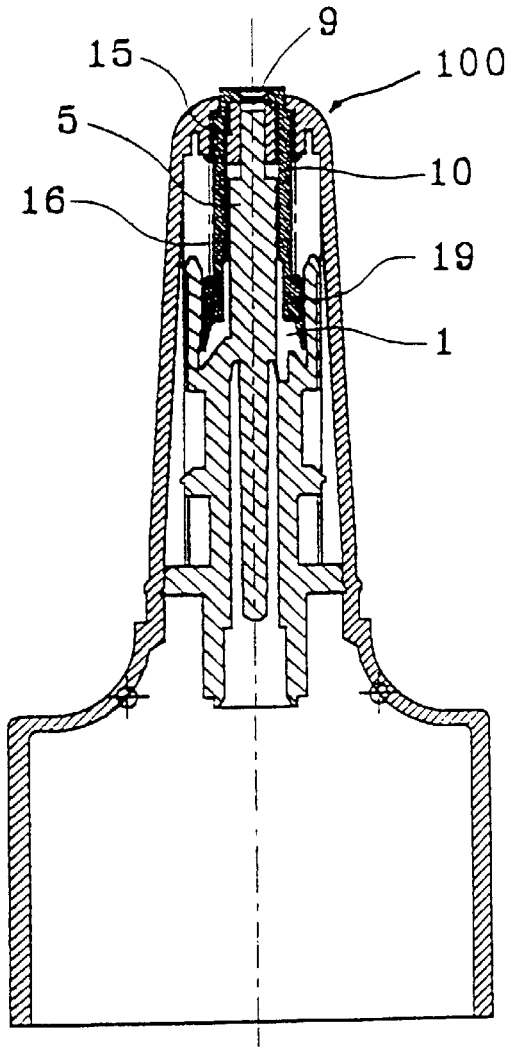
Figure 3:
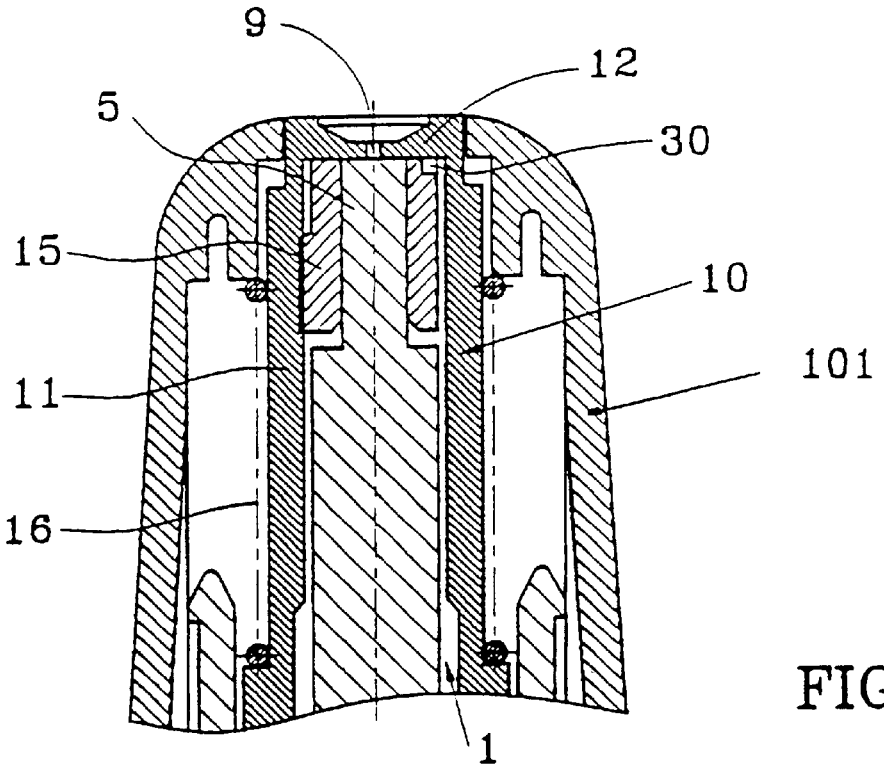
FIGS. 3 and 4 are diagrammatic section views of the top portion of the spray heads shown in FIGS. 1 and 2, when the closure member is respectively in the closed position and in the spray position.

In the example shown in FIGS. 1 to 4, the closure member 10 is urged towards its closed position by a spring 16 which rests firstly against the body 101 of the spray head, and secondly against said moving closure member 10. The insert 5 extends inside the spray head to the vicinity of the spray orifice so that, when the closure member is in the closed position, said spray orifice 9 is closed by the top end face of the insert 5, as shown in FIGS. 1 and 3.

The moving closure member 10 is preferably made in the form of a hollow tubular sleeve 11 which, at one end (the top end in the figures) has an end wall 12 that incorporates the spray orifice 9. The tubular sleeve 11 of the moving closure member 10 is disposed to slide over the insert 5 so as to leave a narrow passageway between the closure member 10 and the insert 5, which passageway forms a portion of the fluid expulsion channel 1. The tubular sleeve and the end wall are preferably non-deformable, the spray orifice being opened by displacing the closure member.

Figure 4:
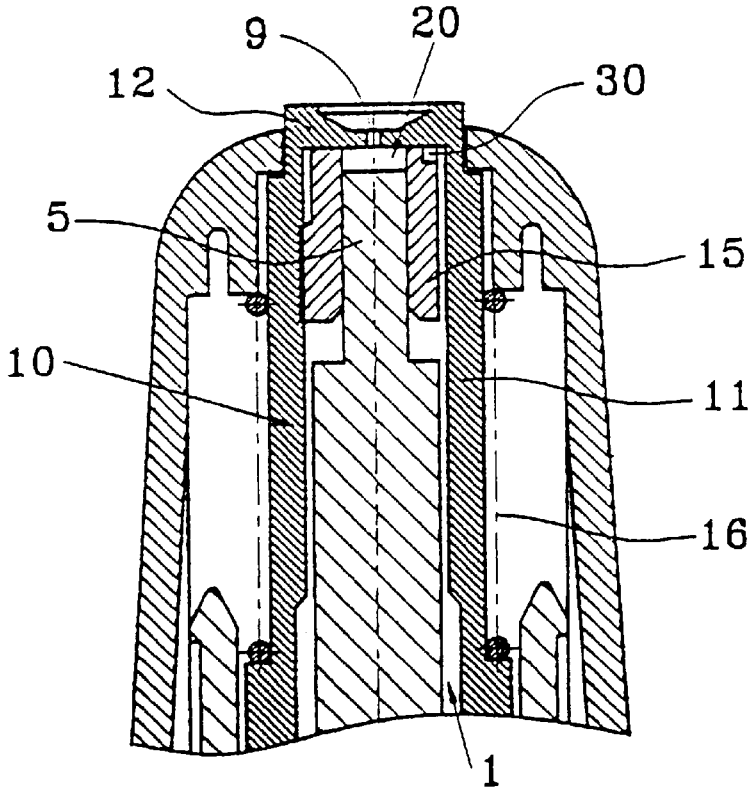

In the invention, in order to guarantee that the fluid is sprayed well, the spray head is provided with a swirl chamber 20 of variable volume and which is formed upstream from the spray orifice 9 when the closure member 10 is in the spray position. This swirl chamber 20 is connected to the expulsion channel 1 via one or more swirl channels 30. As shown in FIGS. 2 and 4, the swirl chamber 20 is formed between the end wall 12 of the closure member 10, in which end wall the spray orifice 9 is situated, and the top end face of the insert 5. Thus, this swirl chamber is of maximum volume in the spray position (FIGS. 2 and 4) and of substantially zero volume in the closed position (FIGS. 1 and 3), in which the top end face of the insert 5 rests in leaktight manner against the end face 12 of the closure member, thereby closing the spray orifice 9.

Preferably, a short hollow tube 15 is fitted in fixed manner inside the tubular sleeve 11 of the closure member 10, in abutment against the end wall 12 thereof. The short hollow tube 15 co-operates with a top end portion of the insert 5, which top end portion is of small diameter so that the inside periphery of the short hollow tube 15 slides on the outside periphery of said top portion of the insert 5 in substantially leaktight manner, thereby preventing fluid from passing at this level, the fluid expulsion channel 1 therefore extending outside said short hollow tube 15. Advantageously, the top end face of the short hollow tube 15 incorporates the spray channels 30 which, in the spray position, connect the expulsion channel 1 to said swirl chamber 20 and which, in the closed position, are closed by said peripheral wall of said top portion of the insert 5. Advantageously, on its outside peripheral wall fitted into the tubular sleeve 11, the short hollow tube 15 is provided with one or more passageways for the fluid, said passageways forming a portion of the expulsion channel 1.

Thus, the geometrical configuration of the spray channels 30 remains unchanged regardless of the position of the closure member 10. In the closed position, they are closed at their downstream ends by the peripheral wall of the insert 5, which downstream ends are opened when the closure member 10 is displaced towards its spray position, thereby creating the swirl chamber 20. Since the geometrical configuration of the swirl channels influences the quality of the generated spray, the fact that this geometrical configuration remains unchanged makes it possible to guarantee that, each time the device is actuated, the quality of the spraying and of the resulting-spray is excellent, regardless of the actuating force on the device. Similarly, in the above-described embodiment, while being of variable volume, the swirl chamber 20 is nevertheless of constant cross-section, which also works in favor of spray quality and constancy.

When the user actuates the spray device, the fluid is put under pressure in the expulsion channel and in the swirl channels. This pressure is transmitted to the piston of the closure member which moves towards its spray position, thereby forming the swirl chamber. As soon as the downstream ends of the channels are unobstructed, the fluid is expelled towards the swirl chamber, and then sprayed through the spray orifice. Because the geometrical configuration of the channels remains unchanged, the fluid pressure build-up is immediate therein as from the start of actuating, so that the resulting spray is always identical and of good quality. In particular, the fact that the channels contain fluid under pressure also accelerates the displacement of the closure member towards its spray position, as soon as the downstream ends of the channels are unobstructed in part. It is thus impossible to generate a spray that is poor or of low quality, even when the device is actuated weakly.

Figure 5:
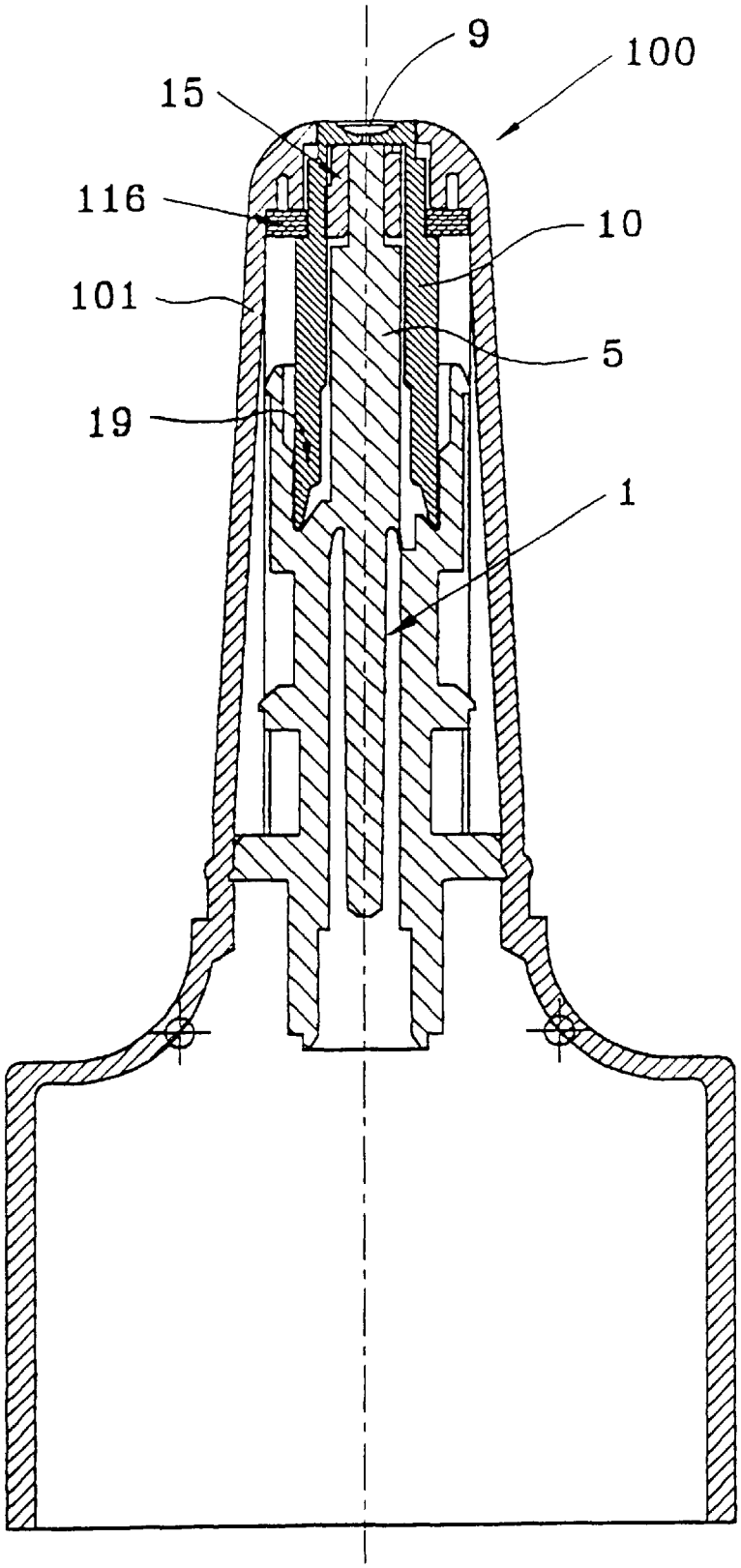
FIG. 5 shows another embodiment of the invention.

FIG. 5 shows an advantageous variant embodiment of the invention. In this variant, instead of being urged into its rest position by a spring, the closure member 10 co-operates with a compressible gasket 116 disposed between the closure member 10 and the body 101 of the head. In the rest position, as shown in FIG. 5, the gasket 116 urges the closure member towards its rest position. When the device is actuated, the gasket 116 is compressed by the closure member 10 under the effect of the pressure of the fluid, and the closure member can move towards its spray position. When the fluid is expelled, the resilience of the gasket 116 returns the closure member 10 to its rest position. This variant offers, in particular, the following advantages: the metal spring is replaced with a gasket made of a plastics material, which is advantageous, in particular in terms of the cost and compatibility of the materials. The gasket 116 also provides leaktightness between the spray head 100 and the closure member 10, and it prevents bacteria or germs from penetrating into said head. In addition, the thickness of the gasket 116 can be considerably smaller than the thickness of the spring, so that the spray head can be of smaller size.

Figure 6:
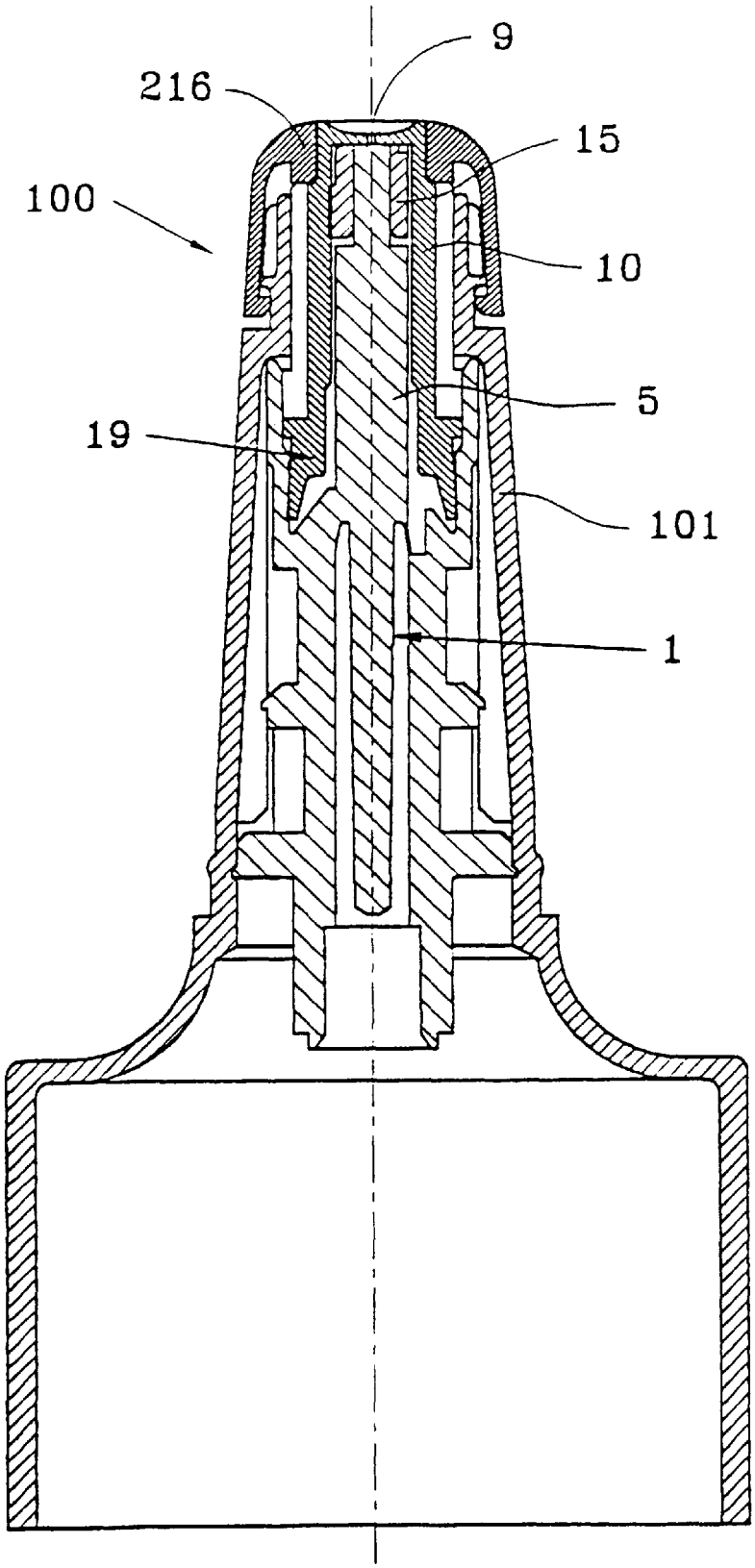
FIG. 6 shows yet another embodiment of the invention.

FIG. 6 shows another advantageous variant of the invention. In this example, an elastically-deformable element 216, such as a cap made of elastomer thermoplastic, overlies the end of the body 101 of the head. The cap 216 is fixed firstly to the body 101 and secondly to the closure member 10, preferably in leaktight manner. It urges the closure member 10 towards its rest position and it is deformed under the effect of the pressure exerted by the fluid on the closure member on actuating the device, so as to enable the closure member 10 to be displaced towards its spray position. Then, the cap 216 returns the closure member to its rest position. This variant offers the advantage of preventing any bacteria or germs from penetrating, even at the end of the head, into the gap situated between the closure member 10 and said cap 216. In this variant, the closure member 10 does not slide relative to said cap 216, so that the gap situated at the end of the head between the cap 216 and the closure member 10 can be rendered completely leaktight.

Advantageously, in all of the above-described embodiments, the spray head 100 may have a bacteriostatic material in one or more surfaces in contact with the fluid to be expelled. In particular, such a bacteriostatic material may be a material acting by contact rather than by putting ions into the fluid.

Other modifications and variants are possible without going beyond the ambit of the present invention as defined by the accompanying claims.

What is claimed is:

1. A spray head (100) for a fluid dispenser for dispensing a fluid, the spray head being provided with an expulsion channel (1) opening out in a spray orifice (9), and with a moving closure member (10) mounted to move between a closed position, in which it closes said orifice (9), and a spray position, said closure member (10) being urged resiliently towards its closed position, and being displaced towards its spray position by the pressure of the fluid, the spray head being provided with a swirl chamber (20) of variable volume, the volume of said swirl chamber (20) being at its maximum when the closure member (10) is in the spray position, and being substantially zero when said closure member is in the closed position, said spray head being characterized in that said closure member (10) is provided with the spray orifice (9) and with swirl channels (30) which, when the closure member is in the spray position, connect said expulsion channel (1) to said swirl chamber (20), the volume and the geometrical configuration of said swirl channels (30) remaining unchanged whatever the position of the closure member (10).

2. A spray head according to claim 1, in which that end of the moving closure member (10) which is opposite from the spray orifice (9) is provided with a piston (19) mounted to slide in leaktight manner in the expulsion channel (1).

3. A spray head according to claim 1, in which, in the closed position, the spray orifice (9) is closed by an insert (5) disposed in fixed manner in the expulsion channel (1), said swirl chamber (20) being formed between said insert (5) and said spray orifice (9) when the closure member (10) moves towards the outside of the spray head into its spray position.

4. A spray head according to claim 3, in which said swirl chamber (20) is cylindrical, the side wall and the top end face being formed by the closure member (10, and the bottom end face being formed by the insert (5).

5. A spray head according to claim 4, in which said swirl channels (30) open out in said side wall of the swirl chamber (20) so that, when the closure member (10) is in the closed position, they are closed by said insert (5).

6. A spray head according to claim 1, in which said moving closure member (10) comprises a hollow tubular sleeve (11) provided with an end wall (12) incorporating the spray orifice (9) at its center, and a short hollow tube (15) fitted in fixed manner inside the tubular sleeve (11) in abutment against said end wall (12), the top surface of said tube (15) that is in abutment against the end wall (12) of the closure member (10) being provided with the swirl channels (30) connecting the outside peripheral surface of said tube (15) to the inside peripheral surface of said tube (15).

7. A spray head according to claim 6, in which said short hollow tube (15) is provided with one or more passageways in its outside peripheral surface fitted into the tubular sleeve (11) of the closure member (10), said passageways being connected to said swirl channels (30) and forming a portion of the expulsion channel (1).

8. A spray head according to claim 6, in which said closure member (10) is disposed to slide around an insert (5) disposed in fixed manner in the spray head, said expulsion channel (1) being defined at least in part between said closure member (10) and said insert (5).

9. A spray head according to claim 1, in which said spray head (100) comprises a body (101), a gasket-forming resilient element (116) being disposed between the moving closure member (10) and the body (101) of the spray head (100), said resilient member (116) urging said closure member (10) towards its closed position and being compressed when the closure member (10) moves towards its spray position.

10. A spray head according to claim 1, in which said spray head (100) comprises a body (101) underlying an elastically-deformable element (216) fixed to said body (101), the closure member (10) co-operating with said element (216) which urges said closure member (10) towards its closed position, and which is deformed when the closure member (10) moves towards its spray position.

11. A spray head according to claim 10, in which the resiliently-deformable element (216) is fixed in leaktight manner to said body (101) of the spray head, and to said closure member (10), so that the leaktightness is guaranteed when the closure member (10) is in all of its positions.

12. A spray head according to claim 10, in which said elastically-deformable element (216) is a cap made of elastomer thermoplastic.

13. A spray head according to claim 1, in which one or more portions of said spray head (100) that are in contact with the fluid include a bacteriostatic material.

14. A spray head for a fluid dispenser for dispensing a fluid, the spray head comprising:

a spray orifice;

an expulsion channel that conveys the fluid to the spray orifice;

an insert disposed in fixed manner in the expulsion channel;

a closure member mounted to move between a closed position, in which the closure member closes the spray orifice, and a spray position; the closure member being urged resiliently towards the closed position, and being displaced towards the spray position by fluid pressure within the spray head;

a swirl chamber of variable volume corresponding to a position of the closure member; and swirl channels communicating with the swirl chamber;

wherein the closure member is provided with the spray orifice and with the swirl channels, such that when the closure member is in the spray position, the swirl channels communicate the expulsion channel with the swirl chamber;

wherein the swirl channels retain a substantially constant volume and geometrical configuration when the closure member moves between the closed position and the spray position; and wherein, in the closed position, the spray orifice is closed by the insert, and the swirl chamber is formed between the insert and the spray orifice when the closure member moves towards an outside of the spray head to the spray position.

15. The spray head according to claim 14, wherein the volume of the swirl chamber is at its maximum when the closure member is in the spray position and is substantially zero when the closure member is in the closed position.

16. A spray head for a fluid dispenser for dispensing a fluid, the spray head comprising:

a spray orifice;

an expulsion channel that conveys the fluid to the spray orifice;

an insert disposed in fixed manner in the expulsion channel;

a closure member mounted to move between a closed position, in which the closure member closes the spray orifice, and a spray position; the closure member being urged resiliently towards the closed position, and being displaced towards the spray position by fluid pressure within the spray head;

a swirl chamber of variable volume corresponding to a position of the closure member; and swirl channels communicating with the swirl chamber;

wherein the closure member is provided with the spray orifice and with the swirl channels, such that when the closure member is in the spray position, the swirl channels communicate the expulsion channel with the swirl chamber;

wherein the swirl channels retain a substantially constant volume and geometrical configuration when the closure member moves between the closed position and the spray position; and wherein the closure member comprises a hollow tubular sleeve provided with an end wall incorporating the spray orifice at a center of the end wall; and a short hollow tube fitted in a fixed manner inside the tubular sleeve, a top surface of the short hollow tube in abutment against the end wall of the closure member, the short hollow tube provided with the swirl channels connecting an outside peripheral surface of the short hollow tube to an inside peripheral surface of the short hollow tube.

17. The spray head according to claim 16, wherein the volume of the swirl chamber is at its maximum when the closure member is in the spray position and is substantially zero when the closure member is in the closed position.

* * * * *